US005411470A

United States Patent [19]

Liptak et al.

[11] Patent Number: 5,411,470

[45] Date of Patent: May 2, 1995

[54] FOOT MASSAGER

[76] Inventors: Michal M. Liptak, 43 Winston Dr., Somerset, N.J. 08873; George Spector, 233 Broadway Rm 702, New York, N.Y. 10279

[21] Appl. No.: 238,530

[22] Filed: May 5, 1994

[51] Int. Cl.[6] ..... A61H 15/00

[52] U.S. Cl. ..... 601/118; 601/28; 601/122

[58] Field of Search ..... 601/19, 20, 27, 28, 601/52, 63, 94, 99, 102, 115–127

[56] References Cited

U.S. PATENT DOCUMENTS

| | | | |
|---|---|---|---|
| 444,597 | 1/1891 | Lichtenstadt | 601/20 |
| 1,630,149 | 5/1927 | Wahrt | 601/119 |
| 1,664,009 | 3/1928 | Weber | 601/19 |
| 1,728,368 | 9/1929 | Saxer | 601/120 X |
| 1,820,895 | 8/1931 | Weber | 601/19 |
| 2,007,737 | 7/1935 | Anderson | 601/122 |
| 2,037,495 | 4/1936 | Brogan | 601/118 |
| 2,101,503 | 12/1937 | Lang | 601/118 |
| 2,104,429 | 1/1938 | Lipsner | 601/118 |
| 2,266,859 | 12/1941 | Grampp | 601/118 |
| 2,369,544 | 2/1945 | Dolan | 601/118 |
| 3,577,985 | 5/1971 | Guffin | 601/122 |
| 3,612,044 | 10/1971 | Gurrola | 601/136 |
| 3,664,334 | 5/1972 | O'Neil | 601/120 |
| 4,109,649 | 8/1978 | Iyomasa | 601/121 |
| 4,378,007 | 3/1983 | Kachadourian | 601/121 |
| 5,123,406 | 6/1992 | Masuda | 601/120 X |
| 5,143,056 | 9/1992 | Yih-Jong | 601/118 |

FOREIGN PATENT DOCUMENTS

| | | | |
|---|---|---|---|
| 356610 | 12/1905 | France | 601/118 |
| 3207693 | 9/1983 | Germany | 601/121 |
| 0593684 | 12/1977 | Switzerland | 601/118 |
| 1695921 | 12/1991 | U.S.S.R. | 601/122 |
| 87001031 | 2/1987 | WIPO | 601/120 |

*Primary Examiner*—Robert A. Hafer
*Assistant Examiner*—Brian E. Hanlon

[57] ABSTRACT

A foot massage device is provided which consists of an elongated cylindrical rod. A pair of rollers are also provided, with each roller being larger in diameter than the rod and concentrically connected to one end of the rod. A plurality of bumps are adjustably randomly arranged upon an outer surface of the rod, so as to engage and massage a sole of a foot under pressure, when the rollers are rolled along a flat support surface.

2 Claims, 1 Drawing Sheet

FOOT MASSAGER

BACKGROUND OF THE INVENTION

The instant invention relates generally to massaging implements and more specifically it relates to a foot massage device, which provides an efficient way of stimulating a sole of a foot of a person. There are available various conventional massaging implements which do not provide the novel improvements of the invention herein disclosed.

SUMMARY OF THE INVENTION

A primary object of the present invention is to provide a foot massage device that will overcome the shortcomings of the prior art devices.

Another object is to provide a foot massage device that is structured in an efficient way to stimulate a sole of a foot of a person, by the sole of the foot rolling the device and engaging a series of bumps therealong.

An additional object is to provide a foot massage device in which the bumps are randomly arranged upon a rigid elongated cylindrical rod having larger rollers at each end to accomplish the desired massaging of the sole of the foot.

A further object is to provide a foot massage device that is simple and easy to use.

A still further object is to provide a foot massage device that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

DETAILED DESCRIPTION OF THE PREFERRED EMBODIMENTS

Figure 1:
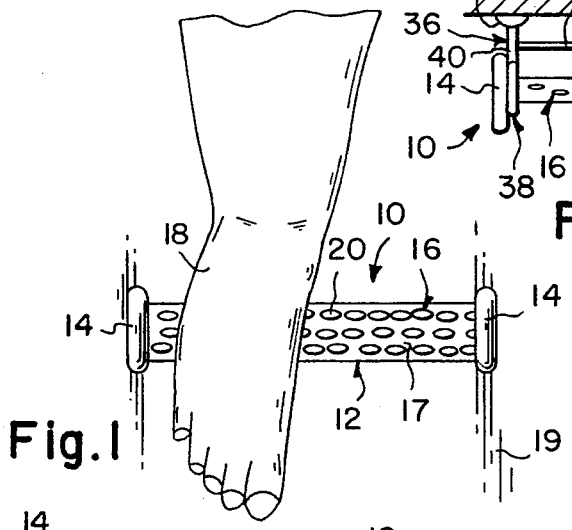
FIG. 1 is an elevational view showing the first embodiment of the instant invention in use.
Figure 2:
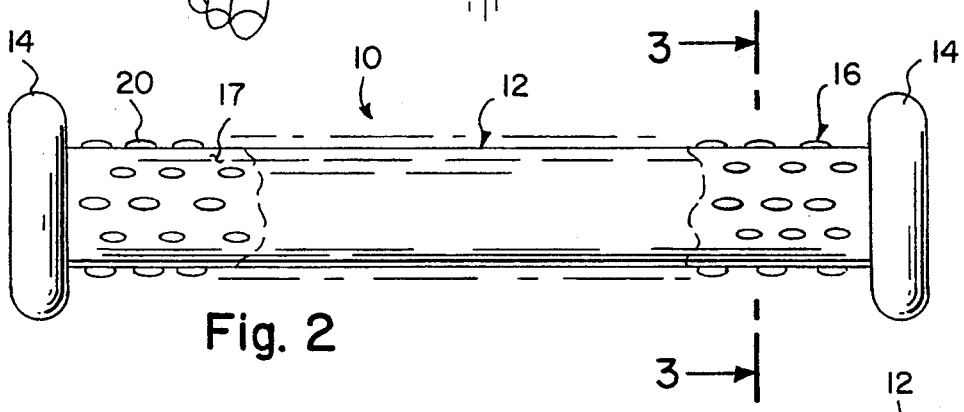
FIG. 2 is an enlarged elevational view of the first embodiment.
Figure 3:
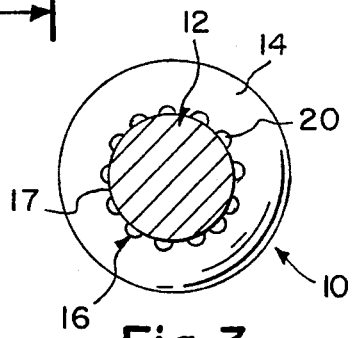
FIG. 3 is a cross sectional view taken along line 3—3 in FIG. 2.

Turning now descriptively to the drawings, in which similar reference characters denote similar elements throughout the several views, FIGS. 1 through 3 illustrate a foot massage device 10, which consists of an elongated cylindrical rod 12. A pair of rollers 14 are also provided, with each larger in diameter than the rod

12 and concentrically connected to one end of the rod 12. A plurality of bumps 16 are randomly arranged upon an outer surface 17 of the rod 12, so as to engage and massage a sole of a foot 18 under pressure when the rollers 14 are rolled along a flat support surface 19.

The bumps 16 on the outer surface 17 of the rod 12 are comprised of rigid ovoidal shaped projections 20 sized to stimulate the sole of the foot 18. The device 10 can be comprised of a unitary rigid configuration.

The device 10 can be made of one solid casting. It also can be made out of a see through plastic material, with a colored liquid therein. The ends of the rollers 14 could contain a logo, emblem or other advertisement.

Figure 4:
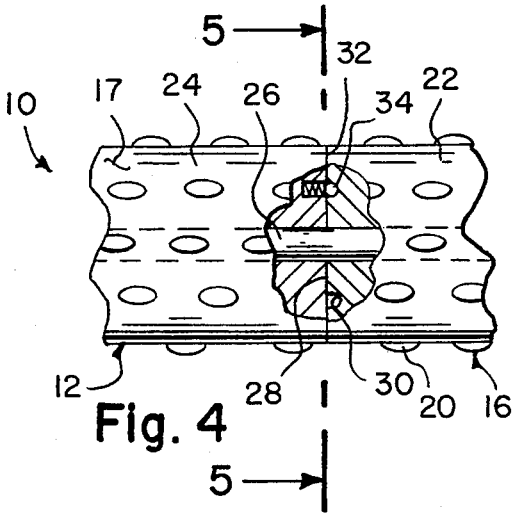
FIG. 4 is an enlarged elevational view with parts broken away and in section of a second embodiment of the instant invention, in which the rod is divided into adjustable segments.
Figure 5:
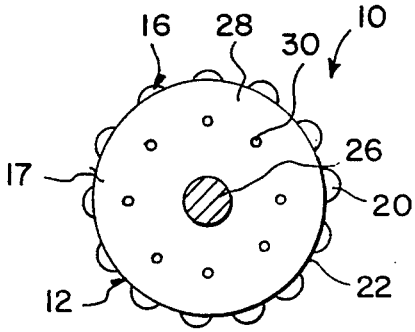
FIG. 5 is a cross sectional view taken along line 5—5 in FIG. 4, showing the sockets radially positioned about the rod.

The foot massage device 10, as shown in FIGS. 4 and 5, further includes the rod 12 divided into a plurality of segments 22 and 24. A shaft 26 extends through a center of segments 22 and 24 of rod 12, so that the segments can rotate about the shaft 26. An abutting end 28 of the first segment 22 has a plurality of sockets 30 radially positioned about the shaft 26. An abutting end 32 of the second segment 24 has one spring biased ball plug 34, to engage with any one of the sockets 30. The segments 22 and 24 can be rotated and retained to change the random pattern of the ovoidal shaped projections 20, when massaging the sole of the foot 18.

Figure 6:
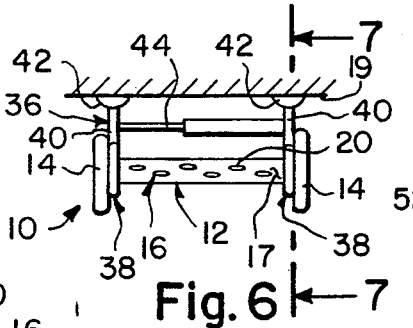
FIG. 6 is a top view of a third embodiment of the instant invention, showing a temporary mounting bracket against a flat surface.
Figure 7:
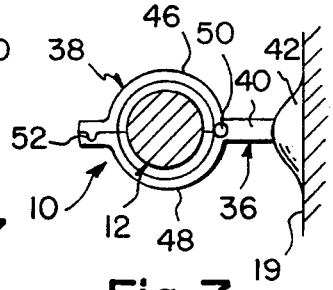
FIG. 7 is a cross sectional view taken along line 7—7 in FIG. 6.

FIGS. 6 and 7 show a temporary mounting bracket 36, so that the device 10 can be rotatively held against the flat support surface 19. The temporary mounting bracket 36 contains a pair of ring bearings 38 spaced apart to fit about opposite ends of the rod 12 adjacent the rollers 14. A pair of shafts 40 are provided, with each connected to and extending from one ring bearing 38. A pair of suction cups 42 are also provided. Each suction cup 42 is affixed to a distal free end of one shaft 40. The suction cups 42 can stick to the flap support surface 19, while the rod 12 can rotate within the ring bearings 38 when the sole of the foot 18 engages with the rod 12.

An adjustable crossbar 44 extends between the pair of shafts 40 and is parallel with the rod 12. The ring bearings 38 are each split into two segments 46, 48. A pair of hinges 50 are provided, with each located on a first side of the two segments 46, 48 of the ring bearing 38 at the connection of the shaft 40. A pair of snap fasteners 52 are also provided. Each snap fastener 52 is located on a second side of the two segments 46, 48 of the ring bearings 38 opposite from the hinge 50. Foot massaging devices 10 of various lengths can be coupled to the temporary mounting bracket 36.

OPERATION OF THE INVENTION

To use the foot massage device 10 shown in FIGS. 1 through 3, a person simply places it upon a flat support surface 19. The sole of the foot 18 is then pressed against the projections 20, to roll the device 10 along the support surface. The projections 20 will massage nerve endings in the sole of the foot 18, to stimulate all of the other connecting nerves of the body.

In FIGS. 4 and 5, the segments 22 and 24 of the rod 12 can be rotated about the shaft 26 and be retained by spring biased ball plug 34 in one of the sockets 30. This will change the pattern of the projection 20, to better massage the sole of the foot 18.

The foot massage device 10 can be coupled to the temporary mounting bracket 36, as shown in FIGS. 6 and 7, by opening the two segments 46, 48 of each ring bearings 38. The telescopic crossbar 44 is then adjusted and the two segments 46, 48 of each ring bearing 38 closed about the rod 12 and retained by the snap fasteners 52. The suction cups 42 are then stuck to the flat support surface 19, which can be a bathtub, inner wall of a swimming pool, a shower floor, an exterior surface of a car body, a bathroom wall and other smooth level surfaces.

While certain novel features of this invention have been shown and described and are pointed out in the annexed claims, it will be understood that various omissions, substitutions and changes in the forms and details of the device illustrated and in its operation can be made by those skilled in the art without departing from the spirit of the invention.

What is claimed is:

1. A foot massage device which comprises:

a) an elongated cylindrical rod;

b) a pair of rollers, each larger in diameter than said rod and concentrically connected to one end of said rod;

c) a plurality of bumps randomly arranged upon an outer surface of said rod, so as to engage and massage the sole of a foot under pressure when said rollers are rolled along a flat support surface; wherein said bumps on the outer surface of said rod are comprised of rigid ovoidal shaped projections sized to stimulate the sole of the foot; further including:

d) said rod being divided into a plurality of segments;

e) a shaft extending through a center of said segments of said rod, so that said segments can rotate about said shaft;

f) an abutting end of said first segment having a plurality of sockets radially positioned about said shaft; and g) an abutting end of said second segment having one spring biased ball plug to engage with any one of said sockets, so that said segments can be rotated and retained to change the random pattern of said ovoidal shaped projections when massaging the sole of the foot.

2. A foot massage device which comprises:

a) an elongated cylindrical rod;

b) a pair of rollers, each larger in diameter than said rod and concentrically connected to one end of said rod;

c) a plurality of bumps randomly arranged upon an outer surface of said rod, so as to engage and massage the sole of a foot under pressure when said rollers are rolled along a flat support surface, further including:

d) said rod being divided into a plurality of segments;

e) a shaft extending through a center of said segments of said rod, so that said segments can rotate about said shaft;

f) an abutting end of said first segment having a plurality of sockets radially positioned about said shaft and g) an abutting end of said second segment having one spring biased ball plug to engage with any one of said sockets, so that said segments can be rotated and retained to change the random pattern of said bumps when massaging the sole of the foot.

* * * * *